US008490453B2

(12) United States Patent
Yamamoto et al.

(10) Patent No.: US 8,490,453 B2
(45) Date of Patent: Jul. 23, 2013

(54) EXTRUSION PRESS

(75) Inventors: Takeharu Yamamoto, Yamaguchi (JP); Koji Nakano, Yamaguchi (JP); Nobuhiko Matsumoto, Yamaguchi (JP)

(73) Assignee: Ube Machinery Corporation, Ltd. (JP)

( * ) Notice: Subject to any disclaimer, the term of this patent is extended or adjusted under 35 U.S.C. 154(b) by 576 days.

(21) Appl. No.: 12/758,229

(22) Filed: Apr. 12, 2010

(65) Prior Publication Data

US 2010/0263428 A1 Oct. 21, 2010

(30) Foreign Application Priority Data

Apr. 15, 2009 (JP) ..... 2009-098506
Jun. 3, 2009 (JP) ..... 2009-133990
Jun. 15, 2009 (JP) ..... 2009-141740

(51) Int. Cl.
*B21C 23/00* (2006.01)

(52) U.S. Cl.
USPC ..... 72/255; 72/254

(58) Field of Classification Search
USPC ..... 72/253.1, 254, 255, 453.01, 465.1, 72/466.8, 482.91
See application file for complete search history.

(56) References Cited

U.S. PATENT DOCUMENTS

| | | | | | |
|---|---|---|---|---|---|
| 3,028,006 | A * | 4/1962 | Petsch et al. | ..... | 72/255 |
| 4,316,378 | A * | 2/1982 | Bellasio et al. | ..... | 72/268 |
| 4,825,677 | A * | 5/1989 | Bessey et al. | ..... | 72/270 |
| 5,595,085 | A * | 1/1997 | Chen | ..... | 72/265 |
| 6,389,863 | B1 * | 5/2002 | Ziemons et al. | ..... | 72/255 |

FOREIGN PATENT DOCUMENTS

| | | | |
|---|---|---|---|
| JP | 3-184616 | A | 8/1991 |
| JP | 5-138235 | A | 6/1993 |
| JP | 5-138236 | * | 6/1993 |
| JP | 6-533 | * | 1/1994 |
| JP | 7-178447 | A | 7/1995 |
| JP | 8-206727 | A | 8/1996 |
| JP | 10-071420 | A | 3/1998 |

* cited by examiner

*Primary Examiner* — Edward Tolan
(74) *Attorney, Agent, or Firm* — DLA Piper LLP (US)

(57) ABSTRACT

A fixing device is configured by: a pushing device of the die unit capable of pushing the die unit from ahead in the direction of extrusion; and a pressing device of the die unit capable of pressing a die ring and the die cassette from above in a direction intersecting the direction of extrusion. The fixing device of the die unit is arranged between the discard cutting device and an end platen and at the same time, the pressing device of the die unit is provided with a fixing metal fitting of the pushing device of the die unit and a pressing metal fitting of the die ring and when the pressing device of the die unit operates and presses and fixes the die ring and the die cassette, the pushing device of the die is fixed.

5 Claims, 18 Drawing Sheets

EXTRUSION PRESS

CROSS-REFERENCE TO RELATED APPLICATIONS

The present invention takes priority from Japanese Patent Application No. 2009-098506 filed on Apr. 15, 2009, Japanese Patent Application No. 2009-133990 filed on Jun. 3, 2009, and Japanese Patent Application No. 2009-141740 filed on Jun. 15, 2009, the entire contents of which are incorporated herein as reference and continued in the subject application.

TECHNICAL FIELD

The present invention relates to an extrusion press that produces a product by extruding a billet, such as an aluminum alloy, held in a container through a die orifice.

Further, the present invention relates to an extrusion press for aluminum alloy, etc., and in particular, to an extrusion press that has reduced idle time as well as shortening its device length to make an attempt to save space.

Furthermore, the present invention relates to an extrusion press of an aluminum alloy, etc., comprising a discard cutting device that cuts off a discard (discarded part), which is the residue of a billet (a part of a billet separated from a product billet) after extrusion of a billet, at an end surface of a die and separates the discard from an extruded product part after separating a container from the die after extrusion molding.

BACKGROUND ART

Among extrusion presses, a direct-type extrusion press that supplies and extrudes a billet in a state where a container is fixed is configured conventionally as follows. That is, the extrusion press is provided with an extrusion stem that is driven by a main ram and moves back and forth in the axial direction and a cylindrical container comprising an inner orifice into which the extrusion stem is inserted so as to be capable of moving back and forth. On the opposite side of the extrusion stem of the container, a die unit is incorporated in a die cassette and the die unit includes a die and a die backer inserted inside a die ring, and a bolster. Above the contact surface between the container and the die, a discard cutting device having a shear blade that is driven by a drive device and moves back and forth in a direction intersecting the direction of extrusion is provided.

Due to such a configuration, when, for example, a cylindrical billet is supplied into the inner orifice of the container and the extrusion stem is moved forward by the main ram, the billet pressed by the extrusion stem is extruded from the die orifice of the die unit and a product in a predetermined shape is produced. After the extrusion of the product is completed, when the container is moved in the direction in which the container is separated from the die, the discard, which is residue (left over) as a result of the extrusion, projects toward the side of the container from the orifice of the die, and therefore, the shear is lowered to shear the discard by the shear blade, and thereby, the discard is recovered and the product can be taken out in the direction of extrusion.

The die unit including the die and the die backer inserted inside the die ring and the bolster is incorporated in the part of the center axis of the die cassette. Then, a top part space for exchanging a die unit is provided over the die cassette so as to facilitate the exchanging of the die unit when the die cassette slides and moves and a die unit is assembled in the die cassette or taken out therefrom (i.e. exchanging of the die unit) at the outside of the device, and the front surface of the die ring is held by a fixing metal fitting in the shape of a horseshoe attached to the die cassette.

As described above, the die unit is placed in the die cassette, and therefore, when the discard and the product are cut off from each other, the shearing force acts in the downward direction and the rear end part of the die rises and inclines and rotates. Accompanying this, the upper end part of the die cassette also tends to incline and rotate toward the side of the container. Because of this, the contact surface of the die with the shear blade inclines and it is no longer possible to completely cut off and separate the discard from the product and part of the discard remains on the contact surface of the die with the shear blade. If the container is pressed against the die in the state where the discard is left on the end surface of the die, it is more likely that burrs and a blister occur during extrusion in the next cycle.

In order to solve the above-mentioned problems, there is disclosed a die locking device, which prevents the die from inclining and rotating by moving the upper end part and the lower end part of the die cassette, on which the die unit is mounted, in the direction of extrusion using a rod provided so as to penetrate through an end platen and by tightening the die cassette to the end platen when cutting off and separating the discard from the product with the shear blade. According to this device, it is possible to solve the problem of the inclination of the die cassette. However, the die is not fixed, and therefore, the gap between the die, the die backer, and the bolster constituting the die unit or the gap formed between the die unit and the die cassette cannot be eliminated and there is a problem that the die inclines when the discard is cut and the discard remains on the end surface of the die (refer to patent literature 1).

Further, there is disclosed a die locking device that comprises a pressure metal fitting to prevent a die from inclining and rotating in the axial direction of the die by pressing the top surface part of the die unit. With this device, the top surface of the die is formed into a tapered form from the end platen toward the container and the top surface of the die in the tapered form is pressed by a pressure metal fitting, and thereby, a pressing force acts in the direction of extrusion and in the direction intersecting the direction of extrusion to prevent the die from inclining and rotating. With the configuration of this locking device, it is difficult to set the die top surface into a tapered form and an acting force sufficient enough to press the die unit in the direction of extrusion cannot be obtained, and the gap between the die, the die backer, and the bolster constituting the die unit or the gap formed between the die unit and the die cassette cannot be eliminated and there is a problem that the discard remains on the end surface of the die (refer to patent literature 2).

The supply of a billet to the conventional rear loading-type short stroke extrusion press is performed by a billet loader attached to the bottom part of the end surface on the side of the extrusion stem of the container in a space part provided by horizontally moving the extrusion stem, and the billet conveyed to the loading inlet of the container is sent into the container by the forward movement of a billet pusher installed inside the main ram. Next, when the billet pusher moves back and at the same time, the extrusion stem moves horizontally to the center position of the press and the extrusion stem moves forward, the billet is pressed and the product is extruded in this configuration.

When the extrusion of the billet is completed, the cylinder for moving the container is activated and the container is moved in the direction toward the extrusion stem while moving back the extrusion stem by moving back the main ram.

Then, while moving back the container, the shear blade of the discard cutting device arranged on the top surface of the die is lowered to cut off and separate the discard (the residue of the billet after the extrusion) and the product from each other. After the cutting of the discard is completed, the shear blade of the discard cutting device is lifted up and the cylinder for moving container is activated and thereby the container is moved in the direction of the die and the container is made to come into contact with the die to extrude a next billet.

In the conventional short stroke extrusion press described above, a space part is provided between the rear end surface of the container and the tip end surface of the extrusion stem and the separation between a virtual extension line in the vertically downward direction of the discard cutting device and the tip end surface of the stem is made greater by providing the space part than the width (distance in a direction of extrusion) between the front and rear surfaces of the container.

For the conventional short stroke extrusion press configured as described above, it is possible to shorten the moving stroke of the extrusion stem and the device length so as to save space. Further, it is possible to simultaneously perform the movement of the stem slide and the cutting operation of the discard by the discard cutting device, and therefore, the idle time can be shortened and the productivity can be improved (refer to patent literature 3).

Then, in the discard cutting device used in the above-mentioned conventional extrusion press, the shear guide is installed securely on the top part on the side of the die of the end platen via the fixed frame and the shear cylinder is arranged on the top part of the shear guide. Further, on the tip end of the piston rod of the shear cylinder, the shear guide and the shear slide capable of stroking in the vertical direction along the shear guide are installed securely, and the shear blade is attached to the side of the die at the lower end part of the shear slide (refer to patent literature 4).

When the discard is cut by the conventional discard cutting device thus configured, the fixed frame, the shear guide, and the shear slide are bent and deformed at the same curvature by the output of the shear cylinder. Because of this, it is required for the discard cutting device to have great rigidity to reduce the amount of deformation so as to be capable of operating even if the shear slide is deformed when cutting the discard, and therefore, it is difficult to reduce the width (dimension in the direction of extrusion) of the discard cutting device so as to make thin the discard cutting device, and it is not possible to set small the dimensions of the space part configured to make greater the separation between the virtual extension line in the vertically downward direction of the discard cutting device and the tip end surface of the extrusion stem than the width between the front and rear surfaces of the container, that is, it is not possible to reduce the device length of the extrusion press by shortening the moving stroke of the container and extrusion stem. Further, there is a limit to the improvement of productivity by shortening the idle time.

Then, in the extrusion press comprising the discard cutting device configured as described above, the cutting blade surface of the shear blade and the die end surface are not coplanar due to the change in temperature of the die and a gap, etc., between the die unit and the die slide, and the position of the die end surface fluctuates in a range of about 0.5 to 1 mm. Then, when the gap between the shear blade and the die end surface increases at the time of cutting a discard, the quality of the cut surface of the discard is deteriorated.

For example, when there is an annular porthole of the billet on the side of the container of the die, the aluminum alloy within the porthole is cut out at the time of the cutting by the shear blade. Then, at the time of the next extrusion, the air in the space from which the alloy has been cut out is confined in the extruded product and bubbles, i.e., blister occurs in the extruded product. Further, because the cut surface produced by cutting is not uniform and has bumps and dips the alloy has been cut out.

In order to solve the above-mentioned problems, there is disclosed a technique to solve the above-mentioned conventional problems by installing the shear cylinder for cutting a discard, which is attached facing downward to the frame provided on the side of the container of the end platen that holds a die, in the direction of extrusion and in the opposite direction of extrusion so as to be capable of rotating and by providing a pressing device having a tilting/rotating cylinder capable of adjusting the gap between the shear blade and the die end surface and a roller device to the frame. As a result, the shear precision can be improved by adjusting the gap between the shear blade and the die end surface to obtain an excellent cut surface (refer to patent literature 5).

In the above-mentioned conventional extrusion press provided with a discard cutting device in which the shear cylinder inclines and rotates, before the cutting of a discard is started, a gap is ensured between the die end surface and the shear blade and when the discard is cut, the whole of the shear cylinder is inclined and rotated by the pressing device so that the shear blade is pressed against the die end surface. With such a configuration, the shear cylinder attached apart from the rotation axis of the shear cylinder oscillates considerably and pressure oil is supplied to the cylinder via a flexible hose having flexibility. The lifetime of the flexible hose is short compared to that of the pipe made of metal and periodic exchange is required.

Further, because in this configuration, the shear cylinder is supported pivotally by the frame provided to the end platen and inclines and rotates, the supporting part receives all of the reaction forces at the time of cutting a discard, and therefore, the device is complicated and has a large steel structure so as to reduce the deformation due to the reaction force at the time of cutting a discard, resulting in the high manufacturing cost.

PATENT LITERATURE

Patent literature 1 Japanese Unexamined Patent Publication (Kokai) No. 3-184616

Patent literature 2 Japanese Unexamined Patent Publication (Kokai) No. 10-71420

Patent literature 3 Japanese Unexamined Patent Publication (Kokai) No. 8-206727

Patent literature 4 Japanese Unexamined Patent Publication (Kokai) No. 5-138235

Patent literature 5 Japanese Unexamined Patent Publication (Kokai) No. 7-178447

SUMMARY OF INVENTION

The present invention has been developed the above-mentioned problems being taken into account and an object thereof is to provide an extrusion press that securely cuts off and separates a discard and a product from each other at the boundary and leaves no discard on the cut surface of the die without rising up a die unit and a rear end surface (on the side of an end platen) of a die cassette that mounts the die unit when cutting off and separating a product and a discard from each other using a discard cutting device.

Another object of the present invention is to provide an extrusion press intended to improve productivity by shortening idle time as well as making an attempt to save space by shortening the device length by providing a billet between an extrusion stem and a container and particularly, a rear loading type short stroke extrusion press.

Still another object of the present invention is to provide a discard cutting device of an extrusion press wherein when the discard cutting device cuts off and separates a discard, which is the residue of a billet after extrusion, and an extruded product part from each other, the discard cutting device can improve shear precision by adjusting a gap between the shear blade and the die end surface to obtain an excellent cut surface as well as reducing the maintenance and manufacturing costs by simplifying the structure.

In order to achieve the above-mentioned objects, an extrusion press according to a first aspect of the present invention is characterized in that in the extrusion press, a die unit has a die ring into which a die and a die backer are inserted internally and a bolster, the die unit is held by a die cassette capable of moving along a die arrangement surface of an end platen, and the extrusion press comprises a fixing device of the die unit to prevent the die from inclining and rotating when a discard is cut by a discard cutting device, wherein: the fixing device includes a pushing device of the die unit capable of pushing the die unit from ahead in the direction of extrusion and a pressing device of the die unit capable of pressing the die ring and the die cassette from above in a direction intersecting the direction of extrusion; the fixing device of the die unit is arranged between the discard cutting device and the end platen and at the same time, the die pressing device is provided with a fixing metal fitting of the die unit pushing device and a pressing metal fitting of the die ring; and when the die unit pressing device operates to press to fix the die ring and the die cassette, the pushing device of the die unit is fixed.

An extrusion press in a second aspect of the present invention is characterized in that the pressing metal fitting of the pressing device of the die unit presses the die ring and the die cassette via an elastic body in the invention in the first aspect.

An extrusion press in a third aspect of the present invention is characterized in that the pressing device of the die unit comprises a locking device and locks the fixing device of the die unit after pressing the die ring and the die cassette in the invention in the first or second aspect.

An extrusion press in a fourth aspect of the present invention is characterized in that the extrusion press comprises a slide device of an extrusion stem and an orthogonal billet loader that has a means for inserting a billet into a container, moves in a direction intersecting the axial direction of the extrusion press to supply a billet and supplies the billet to a space part of the extrusion stem that has slid and moved (rear loading type short stroke), wherein the extrusion press has a discard cutting device configured so that a shear cylinder and a shear guide capable of rotating in the direction toward the die and in the direction away from the die (opposite direction) are attached facing downward to a fixed frame provided on the side of a container of an end platen that holds a die, a shear slide the upper end part of which pivotally supports the piston rod of the shear cylinder and at the same time, to the lower end part of which, a shear blade is attached, is provided within the shear guide so as to be capable of sliding, and the shear slide deforms at a curvature different from that of the fixed frame when a discard is cut.

The invention in a fifth aspect is characterized in that a separation between an end surface on a side of the extrusion stem of the die and an end surface on a side of the die of the container in the discard cutting process after extrusion molding is set so that there is provided a predetermined gap between an end surface on a side of a container of a shear slide, to the lowering lower end part of which a shear blade is attached, and an end surface on a side of the die of the container and at the same time, a separation between the end surface on the side of the extrusion stem of the die and the tip end surface of the extrusion stem is set so as to have a gap between the end surface on the side of the extrusion stem of the container and the tip end surface of the extrusion stem in the invention in the fourth aspect.

An extrusion press in a sixth aspect of the present invention is characterized in that in the extrusion press, a container is separated from a die after extrusion molding and a discard, which is the residue of a billet after extrusion, is cut off at the end surface of the die and separated from an extruded product part, wherein the extrusion press comprises a discard cutting device configured so that a shear cylinder and a shear guide capable of rotating in the direction toward the die and in the direction away from the die (opposite direction) are attached facing downward to a fixed frame provided on the side of a container of an end platen that holds the die; a shear slide, the upper end center part of which pivotally supports a piston rod of the shear cylinder and at the same time, to the lower end part of which on the side of the die, a shear blade is attached, is provided within the shear guide so as to be capable of sliding; and the sliding of the shear slide is not restricted by the deformation of the fixed frame when a discard is cut.

The invention in a seventh aspect according to the invention in the sixth aspect is characterized in that the discard cutting device is provided with a pressing device of the shear guide capable of pressing the shear blade along the end surface of a die when a discard is cut on the side of the die of the fixed frame and a stopper of the shear guide the contact surface of which is spherical in opposition to the pressing device, which is capable of ensuring a gap between the shear blade and the end surface of the die when the cutting of a discard is started on the opposite side of the die.

The invention in an eighth aspect according to the invention in the seventh aspect is characterized in that the pressing device of the shear guide produces an output using an elastic body and a drive cylinder.

ADVANTAGEOUS EFFECTS OF INVENTION

According to the present invention, it is possible to eliminate the gap included in the die unit by pushing the outer circumferential end part of the die ring into which the die and the die backer are inserted internally into the inner part opened on the top part on the side of the container of the die unit mounted on the die cassette in the direction of extrusion. Then in the present invention, the outer circumference of the top part of the die ring is pressed in the above-mentioned state, and therefore, the die unit is pressed against the die cassette and the die cassette is pressed against the support member of the die cassette and it is unlikely that the die inclines toward the side of the container and rises even when a discard is cut after the completion of extrusion. Because of this, it is possible to cut off the discard and the product at the boundary without fail. As a result the yields of the extruded product are also improved.

In the present invention, the pushing device and the pressing device of the die unit are arranged between the die unit and the discard cutting device and at the same time, the pressing device is provided with the fixing metal fitting of the pushing device so that the pressing of the die unit and the fixing of the pushing device can be done in one operation. Because of this, the fixing device of the die can be simplified and it is possible to minimize in size the device and to reduce the manufacturing cost.

Then, in the present invention, the pressing of the die unit is done via an elastic body, the pressing device of the die unit comprises the locking device, and the fixing device of the die is locked after the die ring and the die cassette are pressed. Because of this, it is possible to reduce the amount of consumed energy required to fix and hold the die unit and to make an attempt to save energy of the extrusion press.

The extrusion press of the present invention has the configuration in which the shear guide, which guides the shear slide having the shear blade within the fixed frame to the end platen of which, the discard cutting device is attached, is capable of fluctuating in the upward direction of the axis line of the extrusion press. Due to this configuration, it is possible to deform the fixed frame and the shear slide at different curvatures when a discard is cut. Then, it is possible to reduce the separation between the end surface of the die and the end surface on the side of the die of the container and the separation between the end surface of the die and the tip end surface of the extrusion stem by thinning the shear slide. Because of this, it is possible to reduce the moving stroke of the stem, and therefore, the cycle time is reduced and productivity is improved.

Further, accompanying the reduction in the moving stroke of the extrusion stem, the main cylinder and the main ram can be reduced in size and it is possible to make an attempt to reduce the device length and the cost. Furthermore, the reduction in size of the main cylinder will cause the reduction in amount of hydraulic oil used.

Because the moving stroke of the container can be reduced, it is possible to reduce the size of the moving cylinder of the container and the cost.

The separation between an end surface on a side of the extrusion stem of the die and an end surface on a side of the die of the container in the discard cutting process after extrusion molding is set so that there is provided a predetermined gap between an end surface on a side of a container of a shear slide, to the lowering lower end part of which a shear blade is attached, and an end surface on a side of the die of the container and at the same time, the separation between the end surface on the side of the extrusion stem of the die and the tip end surface of the extrusion stem is set so as to have a gap between the end surface on the side of the extrusion stem of the container and the tip end surface of the extrusion stem, and therefore, the upward movement of the stem and the forward moving action of the billet loader can be performed during the operation of cutting a discard and thus the idle time can be reduced.

At the time of cutting a discard, the shear slide to which the shear blade is attached receives the action of the shear cylinder and the reaction force resulting from the cutting of the discard and deforms toward the side of the die. Then, in the configuration of the present invention, the shear guide is provided so as to be capable of deforming and inclining and rotating so as to follow the deformation of the shear slide.

As described above, the shear slide is deformed and the shear guide is capable of fluctuating to move toward the side of the die, and therefore, the shear blade is pressed against the die end surface and the cut end surface of the discard becomes thin and uniform and thereby the blister phenomenon is unlikely to occur, in which the billet erupts from the container sealed surface at the next time of extrusion because a gap is formed.

Further, the cut surface is not cut out but smooth without bumps and dips formed and it is unlikely that the product includes air and causes blister to occur.

When the shear guide lowers and the tip end of the shear blade reaches the discard at the die front, the shear blade is pressed against the die end surface by the pressing means to correct the initial die bearing and the influence of the temperature change or the multiple-structure of the die is eliminated, and thus, the effect to make thin and uniform the cut end surface of the die is made more effective. Further, even if the shape of the die or the tip end angle of the shear blade is different, it is possible to obtain a cut surface with high precision.

The, the stopper having a spherical contact surface that regulates the position of the shear guide is provided on the side of the container of the shear guide, and the pressing device that presses the shear guide against the stopper is provided on the side of the die of the shear guide. Due to this configuration, it is possible to keep constant the separation between the shear blade and the die end surface even when the cross-sectional area and the shape of the extruded product part at the die end surface, and the shape and tip end angle of the shear blade are different.

Further, because of the configuration in which the output of the pressing device is produced using the elastic body and the drive cylinder, the structure of the device can be simplified, the reduction in size of the device and the reduction in cost can be aimed at, and the safety is also improved.

The present invention may be more fully understood from the description of the preferred embodiments of the invention set forth below, together with the accompanying drawings.

DESCRIPTION OF EMBODIMENTS

The embodiments of an extrusion press according to the present invention are explained below in detail with reference to FIGS. 1 to 3.

Figure 1:
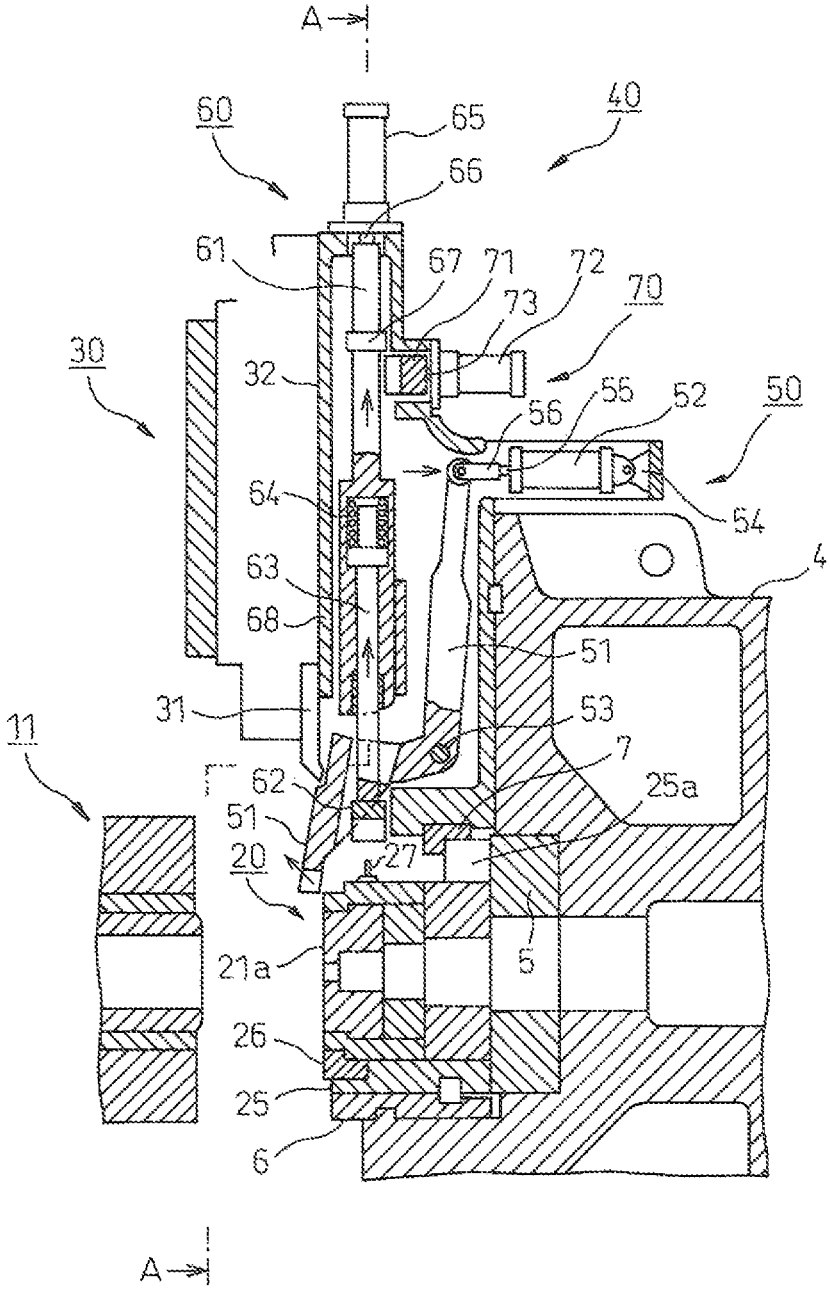
FIG. 1 is a longitudinal section view showing a state where the fixing of a die unit of an extrusion press according to the present invention is released.
Figure 2:
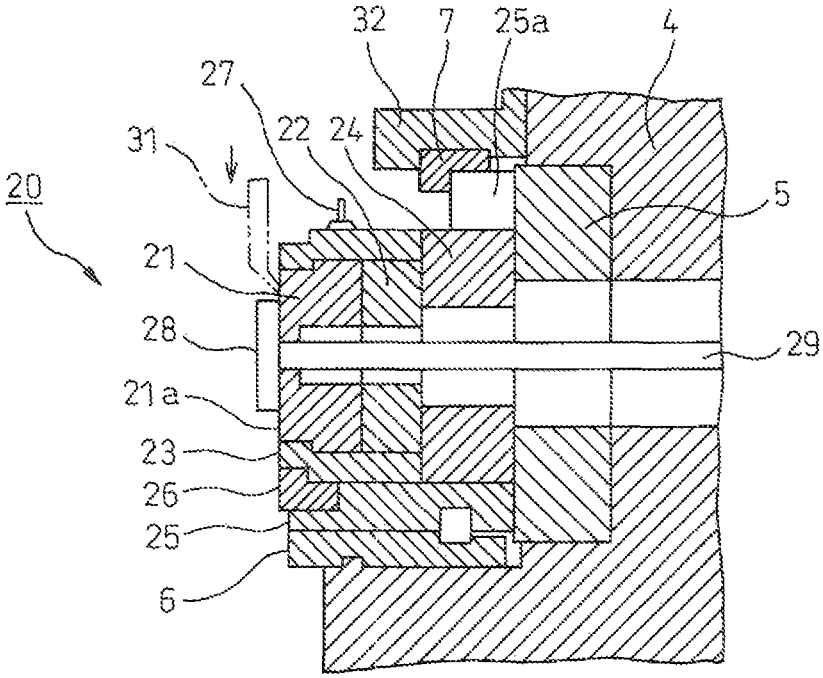
FIG. 2 is a longitudinal section view for explaining a configuration of a die unit.

As shown in FIG. 1 and FIG. 2, the configuration is as follows. A billet is accommodated at a position in opposition to a die arrangement surface of an end platen 4 and a container 11 formed by a cylindrical container liner, a container tire, and a container holder inserted and attached sequentially from the inner side is arranged, and caused to move back and forth in the direction of extrusion by a drive device, not shown schematically. On the die arrangement surface of the end platen 4, a die unit 20 having a bolster 24 and a die ring 23, into which a die 21 and a die backer 22 are inserted internally, is held by a die cassette 25 and is guided by a support member 6 at the bottom part and a guide 7 provided at the top part, so that the die unit 20 is moved back and forth horizontally in a direction perpendicular to the axial direction. To the end surface on the side of the container of the die cassette 25, a fixing metal fitting 26 in the form of a horseshoe is attached, which is a member to regulate the movement of the die unit 20 toward the side of the container.

Reference symbol 30 denotes a discard cutting device, which is mounted on and supported by the end platen 4 and on the lower end part of the discard cutting device, a shear blade 31 is fixed. The shear blade 31 is lowered by a drive device, not shown schematically, to cut off a discard 28 and a product 29 at a boundary surface 21*a* therebetween after the container 11 is moved back toward the side an extrusion stem after the completion of extrusion.

A fixing device 40 of the die unit is basically configured by a pushing device 50 of the die unit, a pressing device 60 of the die unit, and a locking device 70 that locks the pressing device 60 of the die unit, and is provided between the die arrangement surface of the end platen 4 and the discard cutting device 30.

The essential parts of the pushing device 50 of the die unit are configured by: a pressure arm 51 which has a form of a lever, is pivotally supported and can fluctuate so that it causes the die unit 20 to come into contact with a pressure ring 5 by pushing the die unit 20 in the direction of extrusion with the tip end part thereof; a fluid pressure cylinder 52 that drives a pushing metal fitting so as to be capable of fluctuating; and a spindle 53 supported by a bearing, not shown schematically. The fluid pressure cylinder 52 is supported by a main body frame 32 via a clevis 54 and a piston rod 55 is supported by the other end part of the pressure arm 51 via a clevis 56 so as to be capable of fluctuating.

As shown in FIG. 1, the pressing device 60 for the die unit is basically configured by a fixing metal fitting 61, which is guided by the guide part provided in the main body frame 32, moves vertically so as to be capable of fixing the pressure arm 51 of the pushing device 50 of the die unit with the tip end part thereof; a pressing rod 63, which is inserted inside the fixing metal fitting 61, comprises a pressing metal fitting 62 of the die unit 20 at the tip end thereof, is supported by an elastic body 64 and at the same time, is capable of sliding within the fixing metal fitting 61; and a fluid pressure cylinder 65 that moves vertically the fixing metal fitting 61 and the pressing rod 63 arranged coaxially. Then, reference symbol 67 denotes a stepped part that is engaged with the locking device 70. A piston rod 66 of the fluid pressure cylinder 65 is screwed and attached to the fixing metal fitting 61. In the center part of the pressing metal fitting 62, an opening is provided in order to prevent interference with a lifting sling 27 used when the die ring 23 is exchanged with another. Further, the fixing metal fitting 61 and the pressing metal fitting 62 are provided with a detent and the rotation in the axial direction is prevented.

The locking device 70 is basically configured by an engagement block 71 that is engaged with the stepped part 67 of the fixing metal fitting 61 and a fluid pressure cylinder 72 that drives the engagement block 71 so as to be capable of moving back and forth, and a piston rod 73 of the fluid pressure cylinder 72 is attached to the engagement block 71.

Figure 3:
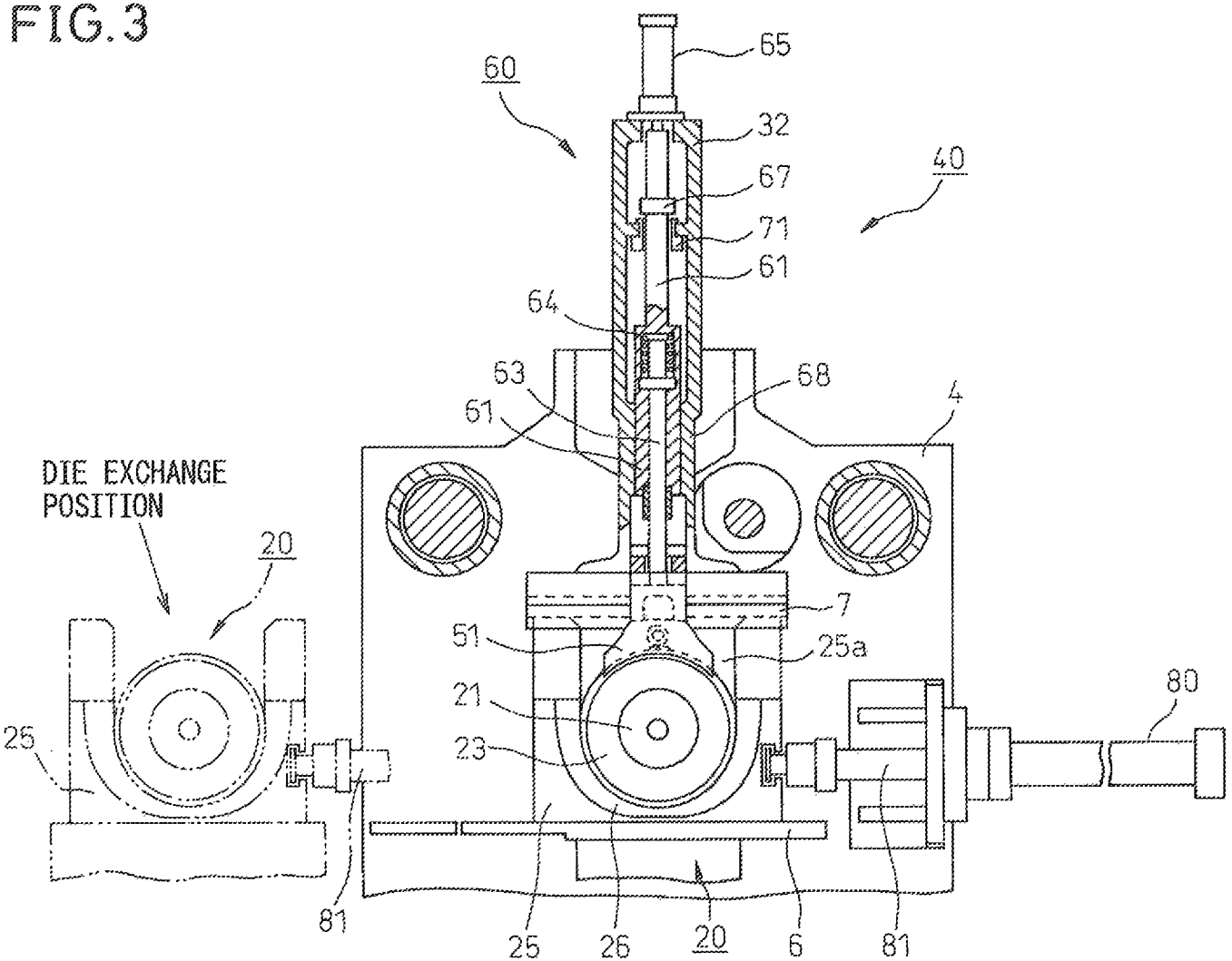
FIG. 3 is a front view when viewed from A-A in FIG. 1.

As shown in FIG. 3, the extrusion press is configured such that when the specifications of the product 29 are modified and the die 21 is exchanged with another, the die cassette 25 is moved in a direction perpendicular to the direction of extrusion and in a position outside the extrusion press, the exchange of the die 21 is effected by a die exchanging device, and for the exchange of the die 21, the fixing metal fitting 26 in the form of a horseshoe is opened upward and in the die cassette 25, an open part 25*a* corresponding to the opening is provided. Reference symbol 80 denotes a drive device of the die cassette 25 in the horizontal direction and the essential parts thereof are configured by the hydraulic cylinder 80 attached to the end platen 4 and a coupling metal fitting 81 with the die cassette 25, and the piston rod of the hydraulic cylinder is attached to the die cassette 25 so as to be able to engage therewith.

As described above, the extrusion press is configured such that the die unit 20 capable of being attached and detached for the exchange of the die 21 is formed so as to be slightly smaller than the separation between the fixing metal fitting 26 in the form of a horseshoe and the pressure ring 5, and the die unit 20 has a gap in the axial direction of extrusion in the die cassette 25 and moves back and forth.

Next, the operation of the fixing device 40 of the die unit configured as described above is explained. When the container 11 moves back as shown in FIG. 1 and the die unit 20 is situated in the center of extrusion shown in FIG. 3 after fixing means of the die unit 20 is released and the die 21 is exchanged with another, the fixing device 40 of the die unit is operated.

A pressurized fluid is supplied to the side of the head of the fluid pressure cylinder 52 and the piston rod 55 is moved forward. The piston rod 55 is rotated about the spindle 53 by fluctuating the pressure arm 51 to the leftward direction and thus the tip end part of the pressure arm 51 comes into contact with the outer circumferential edge part of the end surface of the die ring 23 and moves forward, and thereby, the die unit 20 is caused to come into close adhesion with the pressure disc 5. Due to this, the gap formed in the axial direction of the die unit 20 and the die cassette 25 is eliminated.

The piston rod 66 is lowered by supplying a pressurized fluid to the side of the head of the fluid pressure cylinder 65. The fixing metal fitting 61 is guided to a guide part 68 of the main body frame 32 and the tip end part set into the form of an R presses and fixes the pressure arm 51. Next, the pressing metal fitting 62 inserted inside the fixing metal fitting 61 and the tip end part of which is formed into the form of an arc presses the outer circumferential part of the die ring 23 and causes the die unit 20 and the die cassette 25 to come into close adhesion with the support member 6 at the bottom part. The close adhesion force is output by a compression force of the elastic body 64. Due to this, the gap between the die unit 20 and the die cassette 25 and the gap between the die cassette 25 and the support member 6 at the bottom part are eliminated. As the elastic body 64, a compression coil spring is used preferably.

Then, by supplying a pressurized fluid to the side of the head of the fluid pressure cylinder 72 and causing the engagement block 71 to engage with the stepped part 67 of the fixing metal fitting 61, the fixing of the die unit 20 is performed. The state where the die unit 20 is fixed is shown in FIG. 4.

As described above, the extrusion press is configured such that despite the presence of the gap in the axial direction of the die unit 20 and the die cassette 25 that mounts the die unit 20, the gap between the die cassette 25 and the support member 6 at the bottom part, and the open part provided at the top part of the die cassette 25 for the exchange of the die 21, the die unit 20 is pressed and fixed in the two directions, i.e., from ahead and from above, and therefore, it is unlikely that the die 21 inclines when the discard 28 is sheared. Because of this, the discard 28 is sheared from the product 29 at the boundary without fail.

Figure 4:
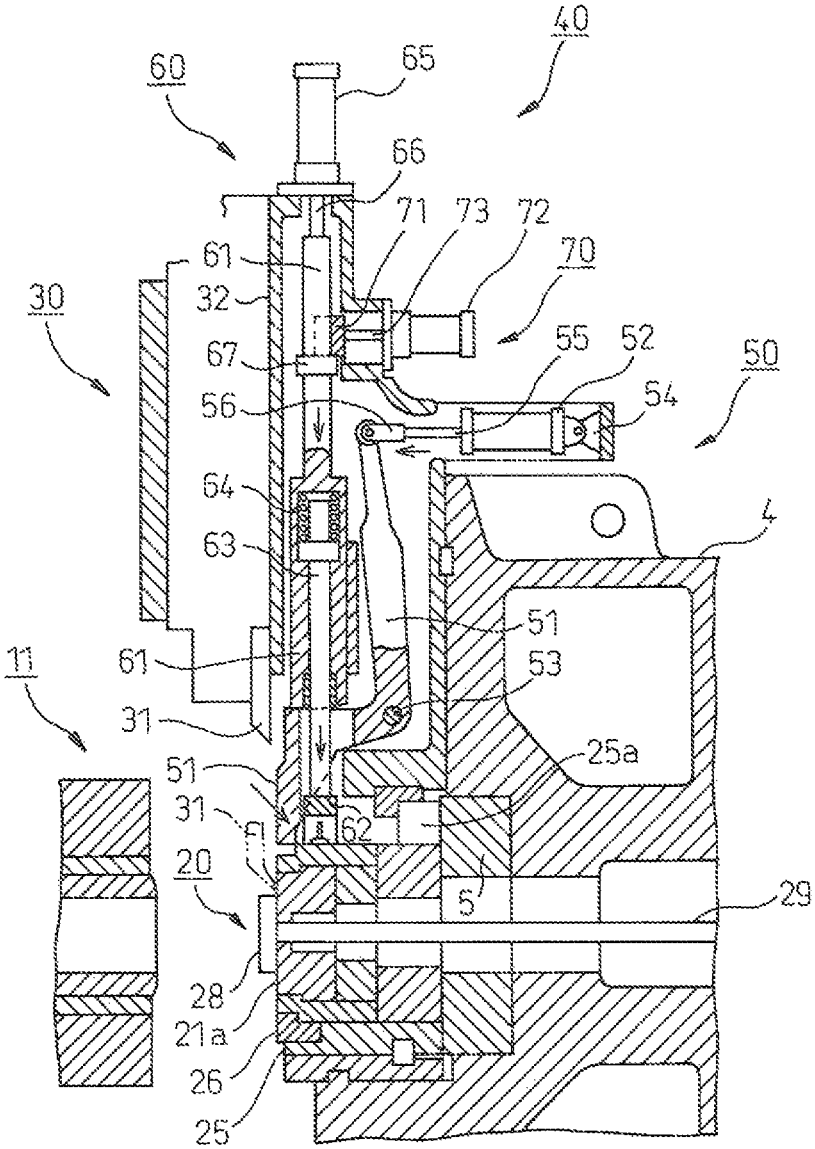
FIG. 4 is a longitudinal section view showing a state where a die unit is fixed.

FIG. 4 shows the state where the die unit 20 is fixed. The releasing of the state where the die unit 20 is fixed can be performed by the reverse procedure of the operation of fixing described above.

As the above-mentioned fluid pressure cylinder, either a pneumatic cylinder or a hydraulic cylinder may be used. Such a configuration may be accepted, in which a mechanism that converts a rotational motion into a liner motion, for example, an electric motor, a ball screw, a ball nut, etc., is used.

Figure 5:
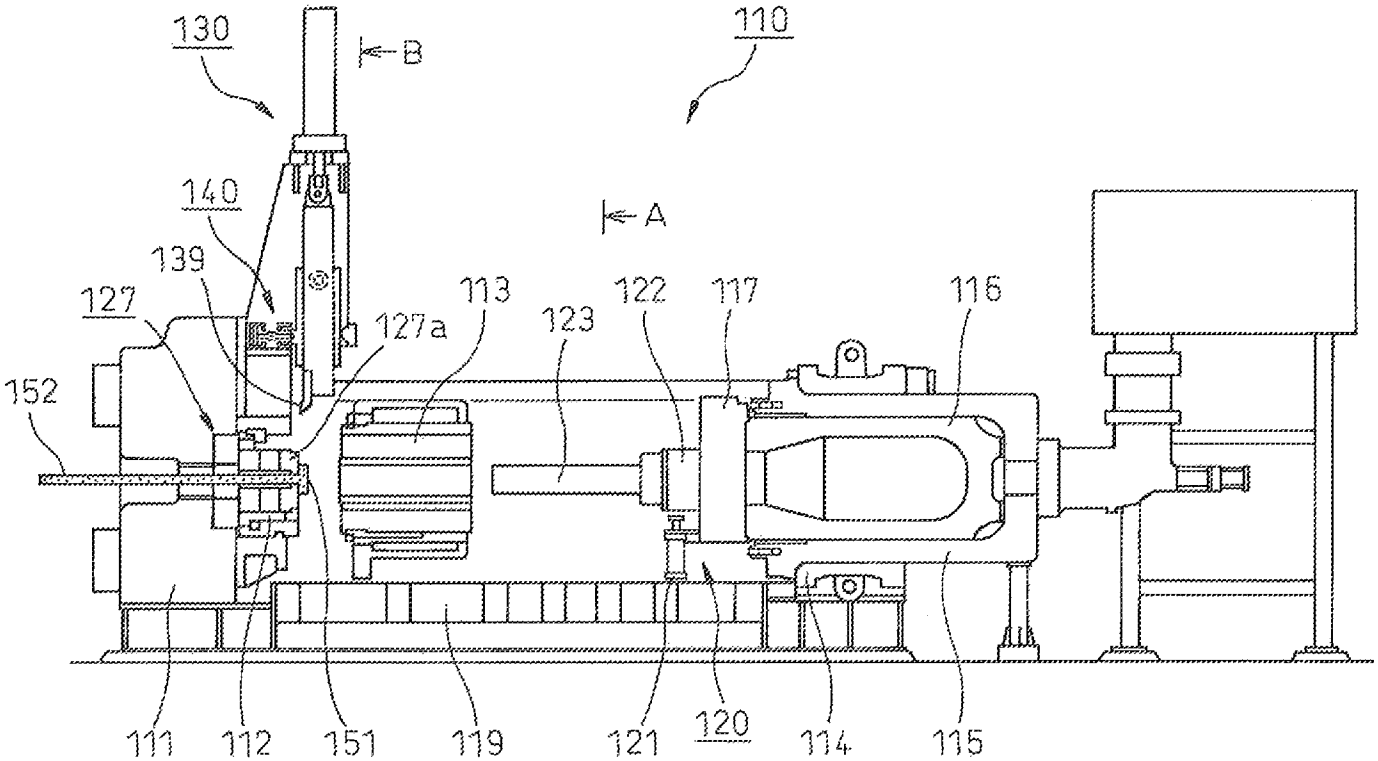
FIG. 5 is an overall view of a rear loading type short stroke extrusion press showing an embodiment of the present invention.
Figure 6:
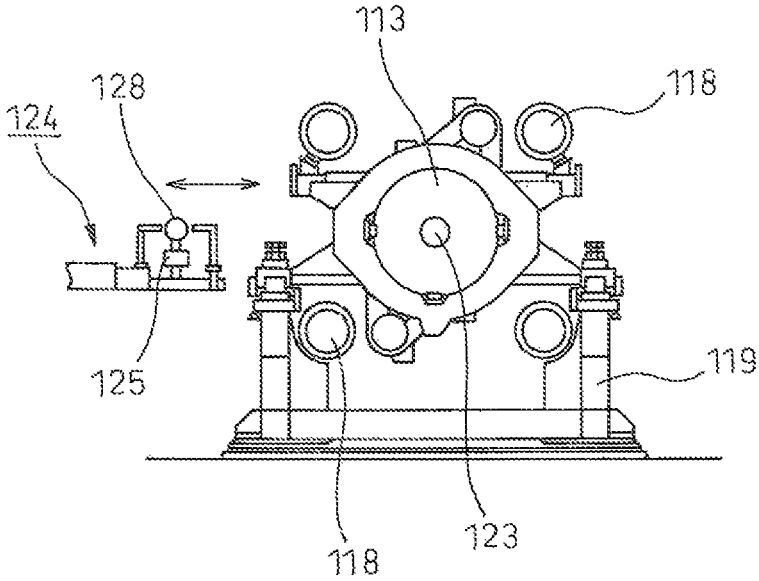
FIG. 6 is a front view when viewed from A in FIG. 5.

FIG. 5 and FIG. 6 show an extrusion press 110, in particular, a rear loading type short stroke extrusion press 110. In the figure, reference symbol 111 denotes an end platen, 112 denotes a die slide on which a die unit 127 is mounted, 113 denotes a container that loads a billet 128, 114 denotes a main cylinder housing, 115 denotes a main cylinder, 116 denotes a main ram for product extrusion, 117 denotes a main crosshead integrally attached to the tip part of the main ram 116, and 119 denotes a machine base.

The main cylinder housing 114 is provided with a side cylinder, not shown schematically, which moves the main crosshead 117 back and forth.

Reference symbol 120 denotes a slide device of an extrusion stem 123 and to the tip end part of the main crosshead 117, a stem slide 122 is attached so as to intersect the direction of movement of the main crosshead 117 and to be capable of moving upward from the axial line. Then, reference symbol 121 denotes a cylinder for moving the stem slide 122 provided below the main crosshead 117.

To the stem slide 122, the extrusion stem 123 that extends to the side of the container 113 is attached. The extrusion stem 123 is configured so as to be capable of moving between the extrusion position and the standby position by the operation of the moving cylinder 121.

Reference symbol 124 shown in FIG. 6 denotes an orthogonal billet loader that moves horizontally and supplies the billet 128 to the extrusion press and is configured to comprise an inserting means 125 for loading a billet in the container 113. Reference symbol 118 denotes a tie bar that connects the end platen 111 and the main cylinder housing 114. The container 113 is driven by a container shift cylinder, not shown schematically, and attached to the end platen 111.

Then, to the top part on the side of the container 113 of the end platen 111 that holds the die unit 127 at the front surface, a discard cutting device 130 that cuts off a discard 151, which is the residue of the billet 128 after extrusion, from an extruded product 152 is attached. To the discard cutting device 130, a pressing device 140 that press a shear blade 139 against the end surface of a die 127*a* is attached.

Figure 7:
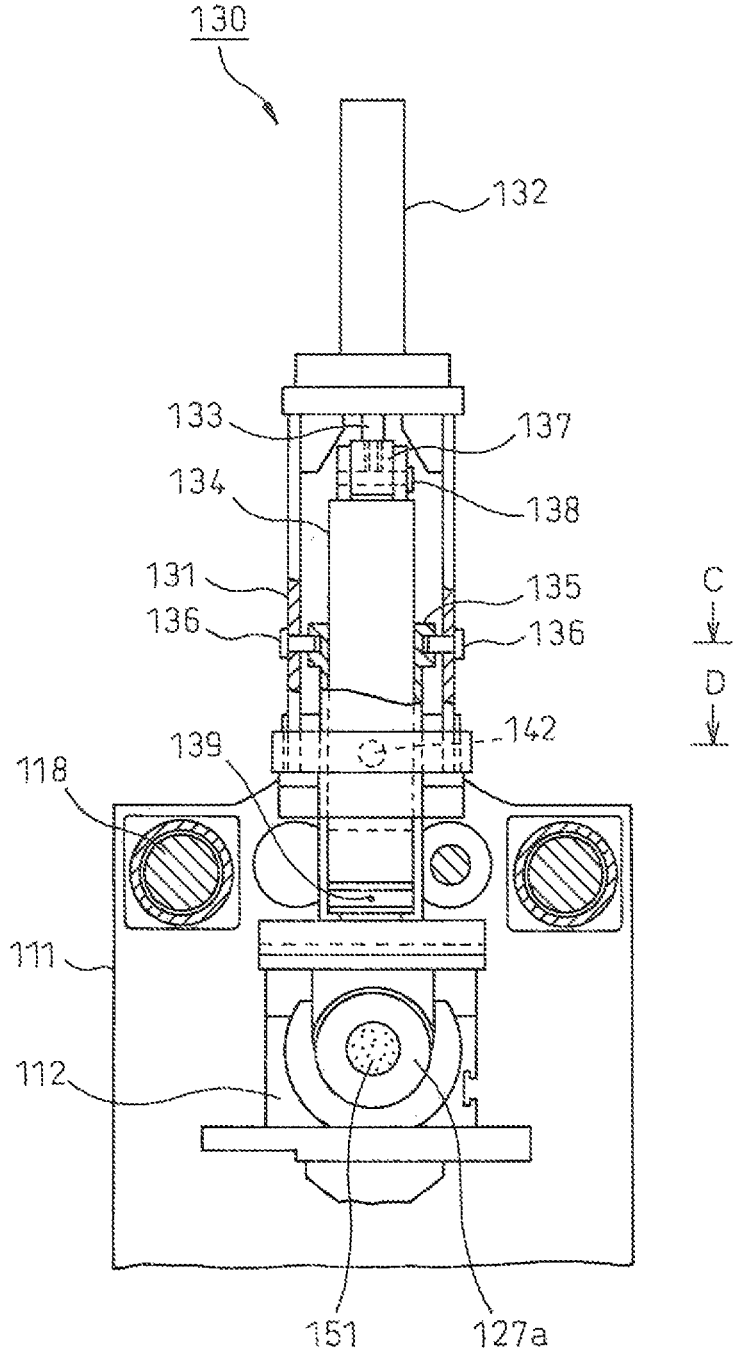
FIG. 7 is a front view when viewed from B in FIG. 5.
Figure 8:
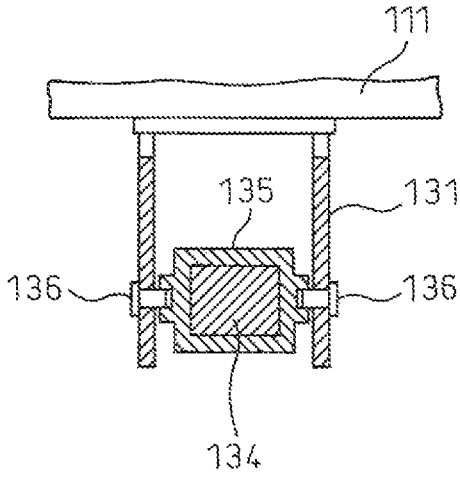
FIG. 8 is a plan view when viewed from C in FIG. 7.
Figure 9:
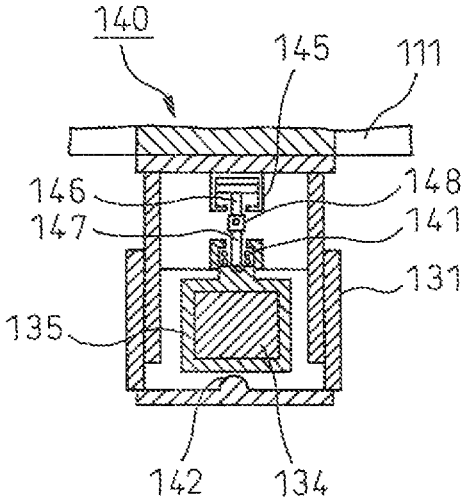
FIG. 9 is a plan view when viewed from D in FIG. 7.

Next, details of the discard cutting device 130 are explained with reference to FIGS. 7 to 9. As shown schematically, reference symbol 131 denotes a fixed frame attached on the top surface of the die 127*a* of the end platen 111, 132 denotes a shear cylinder, and 133 denotes a piston rod and to the tip end of the piston rod 133, a shear slide 134 is attached via a clevis 137 and a clevis pin 138. Then, on the side of the die at the lower end part of the shear slide 134, the shear blade 139 is attached facing downward.

At the center part of the fixed frame 131 below the shear cylinder 132, a shear guide 135 into which the shear slide 134 is inserted is provided so as to be supported by a spindle 136 attached to the fixed frame 131 and capable of inclining and moving. As shown in FIG. 9, the shear guide 135 is pressed and moved toward the direction of the container 113 by an elastic body 141 of the pressing device 140 provided below the shear guide 135 and the movement is regulated by a stopper 142 having a spherical surface that comes into contact with the shear guide 135. This state determines the position of the entrance of the shear blade 139 that lowers vertically toward the die 127*a*.

Further, the pressing device 140 is provided with a drive cylinder 145 and a connecting spindle 147 screwed and installed to the shear guide 135 is coupled to a cylinder rod 146 of the drive cylinder 135 via a spherical coupling 138 and thus the shear guide 135 is made capable of moving in the axial direction of the extrusion press. Before the shear blade 139 lowers and comes into contact with the discard 151, the drive cylinder 145 is activated and thus the shear guide 135 and the shear slide 134 are inclined and rotated, and thereby, the shear blade 139 is pressed against the end surface of the die 127*a*.

Due to the configuration in which a flexible structure is used for the shear guide 135 and the shear slide 134 so that they can deform at a curvature different from that of the fixed frame 131, and therefore, it is possible to absorb the reaction force at the time of cutting a discard and to make an attempt to thin and downsize the discard cutting device.

Figure 10:
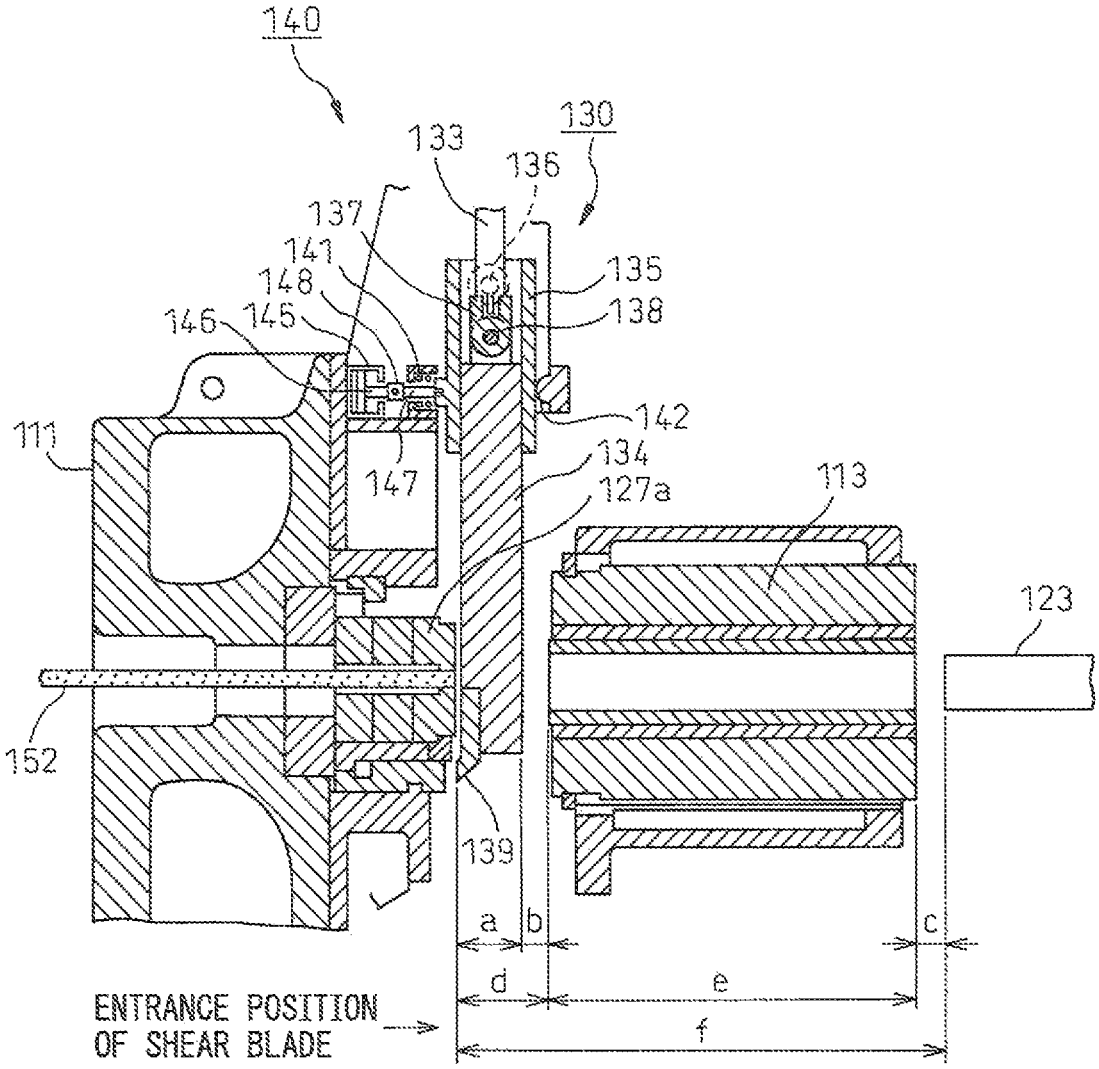
FIG. 10 is a section view of essential parts of a discard cutting device used in the present invention.

The positional relationship between the die 127*a*, the container 113, and the extrusion stem 123 when the discard 151 is cut is explained using FIG. 10.

In the figure, reference symbol "a" denotes the dimension in the direction of thickness of the shear blade 139 and the shear guide 134 of the discard cutting device 130. Reference symbol "b" denotes the dimension of a gap between the end surface of the shear slide 134 and the end surface on the side of the die of the container 113 when the container 113 is at the moved back position, and given as a predetermined gap that does not cause interference with the container 113 when the shear slide 134 lowers. Reference symbol "c" denotes the dimension of a gap between the end surface on the side of the stem of the container 113 when the extrusion step 123 is at the moved back position and the tip end surface of the extrusion stem 123, and given as a predetermined gap that does not cause interference with the container 113 even when the extrusion stem 123 moves when the billet 128 is supplied. Reference symbol "d" denotes the moving-back stroke of the container 113 and at the same time, the total dimension of "a" and "b", and "e" denotes the dimension of the full length of the container 113. Reference symbol "f" denotes the dimension of a space between the blade surface of the shear blade 139 and the tip end surface of the extrusion stem 123 when the extrusion stem 123 is at the moved back position and at the same time, the total dimension of "c", "d", and "e".

In the present invention, it is possible to make "a", which is the dimension in the direction of thickness of the shear blade 139 and the shear slide 134 of the discard cutting device 130 smaller than the conventional dimension and due to this, the dimension "f" of the space between the blade surface of the shear blade 139 and the tip end surface of the extrusion stem 123 when the extrusion stem 123 is at the moved back position is reduced.

The gap between the position of entrance of the shear blade 139 and the end surface of the die 127*a* is very slight and the influence of this dimension on the device length can be ignored.

The operation of the rear loading type short stroke extrusion press 110 of the present invention is explained using FIGS. 11A to 11I. The explanation of the operation is given not from the start of one cycle, but a series of procedures after the completion of the extrusion step is explained in order to make clear the relationship with the present invention.

Figure 11A:
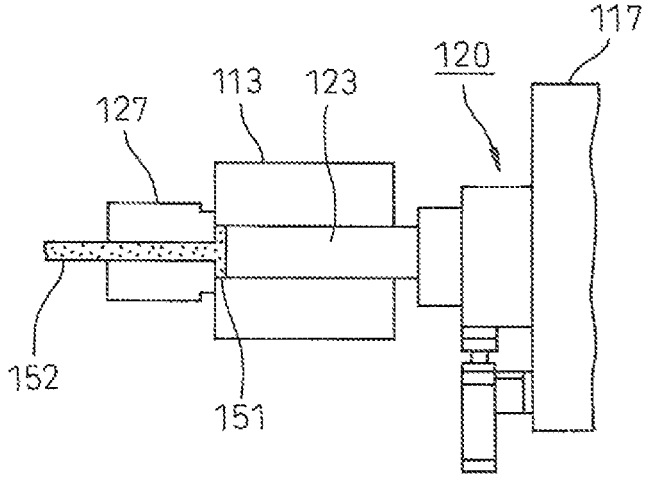
FIG. 11A is an explanatory diagram of the operation of the present invention.
Figure 11B:
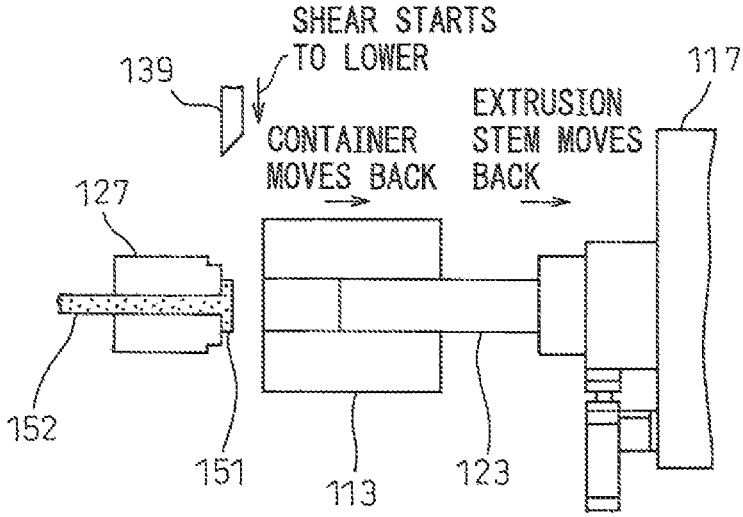
FIG. 11B is an explanatory diagram of the operation of the present invention.
Figure 11C:
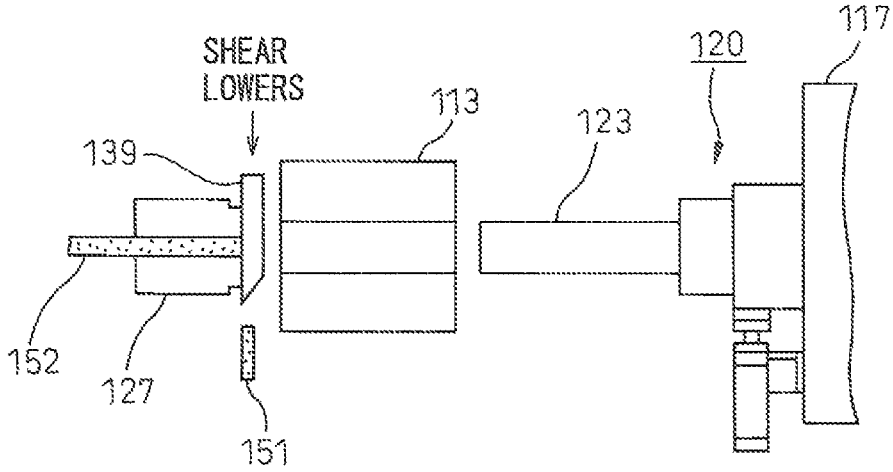
FIG. 11C is an explanatory diagram of the operation of the present invention.
Figure 11D:
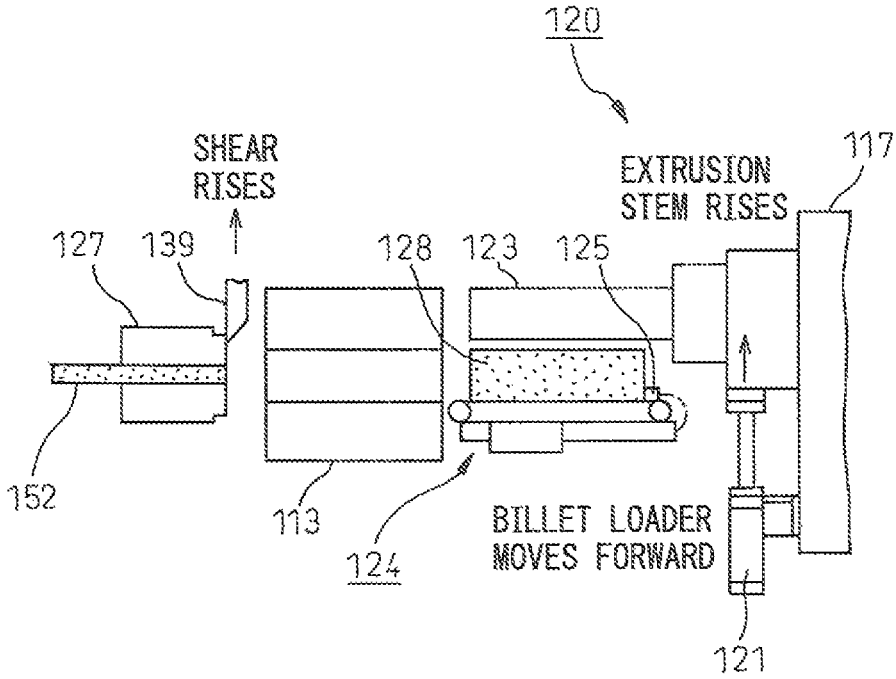
FIG. 11D is an explanatory diagram of the operation of the present invention.
Figure 11E:
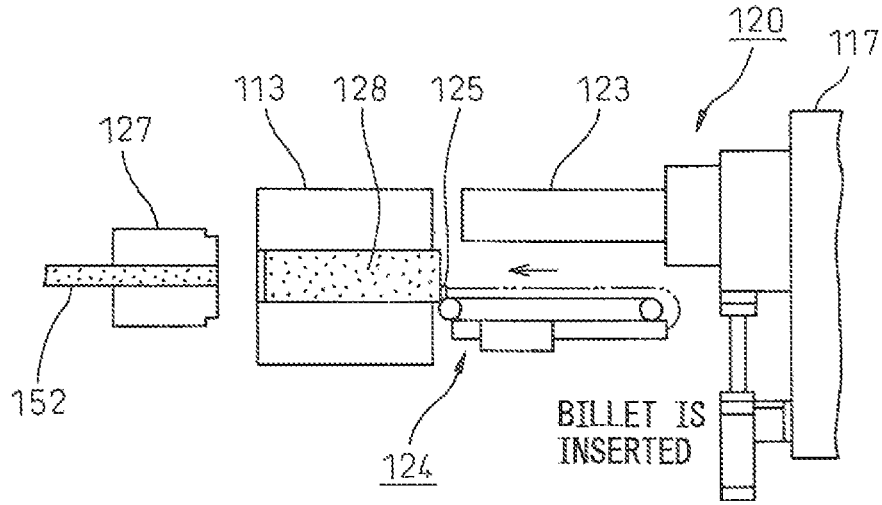
FIG. 11E is an explanatory diagram of the operation of the present invention.
Figure 11F:
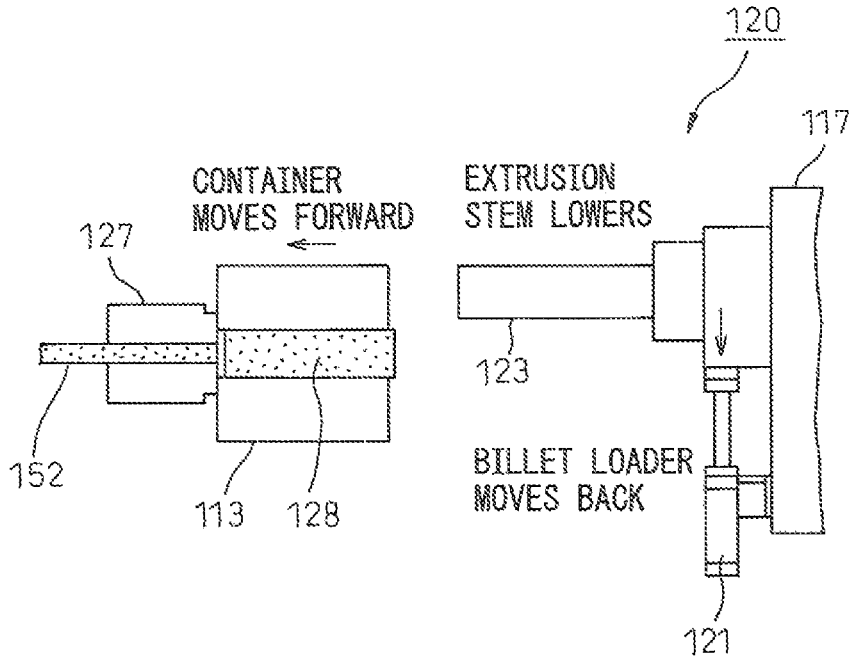
FIG. 11F is an explanatory diagram of the operation of the present invention.

FIG. 11A shows a state where extrusion is completed after the discard 151 is extruded and left and the forward movement of the extrusion stem 123 is terminated. In FIG. 11B, while the extrusion stem 123 is moved back by moving back the main ram 116, a container shift cylinder, not shown schematically, is activated and thus the container 113 is also moved back (moved to the side of the extrusion stem). (FIG. 11C) The discard cutting device 130 is lowered and the discard 151 is cut off by the shear blade 139 and removed, and at the same time, the main ram 116 returns to the limit of backward movement.

Figure 11G:
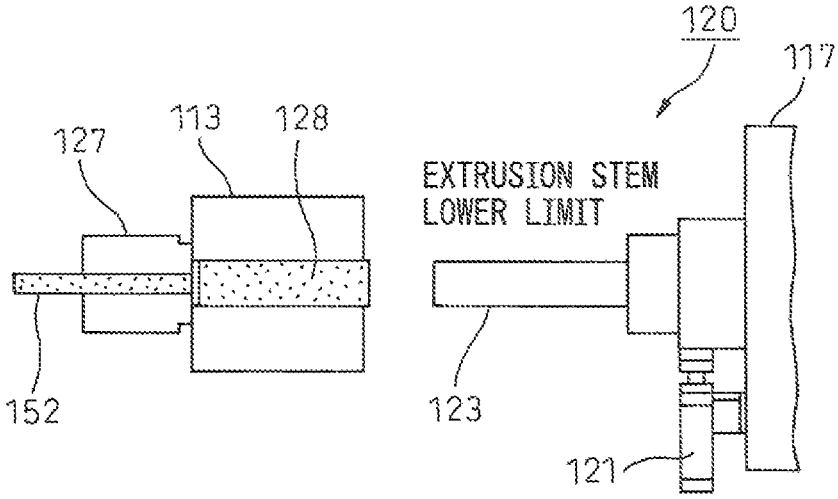
FIG. 11G is an explanatory diagram of the operation of the present invention.
Figure 11H:
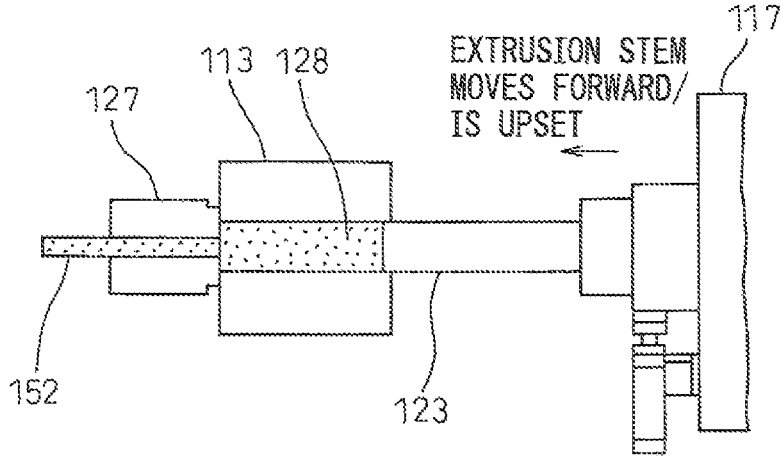
FIG. 11H is an explanatory diagram of the operation of the present invention.
Figure 11I:
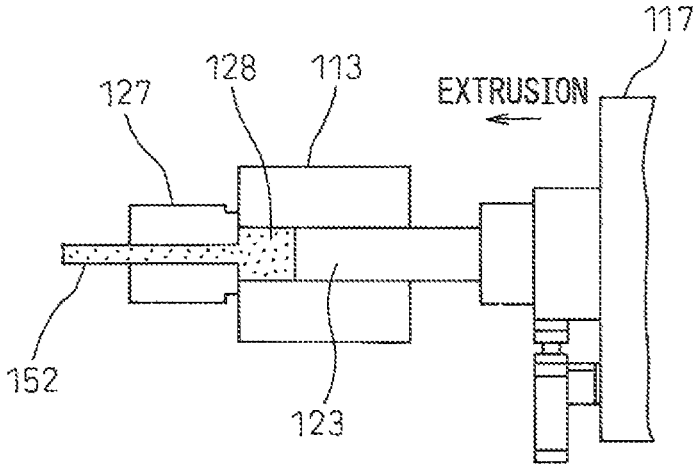
FIG. 11I is an explanatory diagram of the operation of the present invention.

(FIG. 11D) After the discard 151 is cut off and removed, while the shear blade 139 is raised, the slide device 120 of the stem is activated and thereby the extrusion stem 123 is moved upward. Subsequently, the billet loader 124 is moved forward into the space from which the extrusion stem has moved and the billet 128 is supplied. (FIG. 11E) The inserting means 125 provided to the billet loader 124 is activated and the container 113 is loaded with the billet 128. (FIG. 11F) While moving back the billet loader 124, the extrusion stem 123 is lowered and returned to the center position of the extrusion press and at the same time, the container 113 is moved forward and caused to come into contact with the die unit 127. FIG. 11G shows a state where the lowering of the extrusion stem 123 is terminated.

Next, (FIG. 11H) the extrusion stem 123 is moved forward and the billet 128 is upset and subsequently, (FIG. 11I) the extrusion stem 123 is moved forward and thus the desired extruded product 152 is obtained via the die unit 127.

As explained above, the rear loading type short stroke extrusion press of the present invention comprises the discard cutting device having a flexible structure so that the discard cutting device can deform easily when cutting a discard, and therefore, it is possible to reduce the moving stroke of the extrusion stem and the container. Due to this, it is possible to improve productivity by shortening the idle time of the extrusion stem and to shorten the device length of the extrusion press.

Further, it is designed so that the shear blade is pressed against the end surface of the die when cutting a discard, and therefore, the cut surface of a discard is smooth and the number of defective products is reduced, and the productivity is improved considerably.

FIG. 12 to FIG. 15 show another embodiment of the present invention and reference symbol 211 denotes an end platen, 212 denotes a die unit, 213 denotes a die slide, 215 denotes a guide member that guides the movement of the die slide 213 in the horizontal direction perpendicular to the plane of the paper, 214 denotes a support member of the guide member 215, and 216 denotes a block that receives a pressing force from the die unit 212. In the center part of the end platen 211 and the block 216, an orifice is provided, through which a product 242 extruded from a die 212*a* passes. Reference symbol 241 denotes the residue of a billet after extrusion, that is, a discard that is cut off and separated from the product 242 and recovered.

The die unit 212 is composed of a plurality of publicly-known parts as shown schematically. Then, the die unit 212 is mounted on the die slide 213 and the movement in the direction of stem is regulated by a metal fitting 257 formed into the form of a horseshoe. Reference symbol 217 denotes a container, the essential parts of which are composed of a container liner, a container main body, a container holder, etc., and the container is loaded with billet.

To the top part on the side of the container of the end platen 211 that holds the die unit 212 on the side of the front surface, a discard cutting device 220 is attached.

In the discard cutting device 220, reference symbol 221 denotes a fixed frame attached to the top surface of the die unit 212, 222 denotes a shear cylinder, and 223 denotes a piston rod. To the tip end of the piston rod 223, a clevis 227 and a clevis pin 228 are attached and the clevis 227 and the clevis 228 are arranged in the center part of the upper end of a shear slide 224.

Then, on the side of the die at the lower end part of the shear slide 224, a shear blade 229 is attached facing downward, which cuts off and separates the discard 241 from the product 242.

Figure 14:
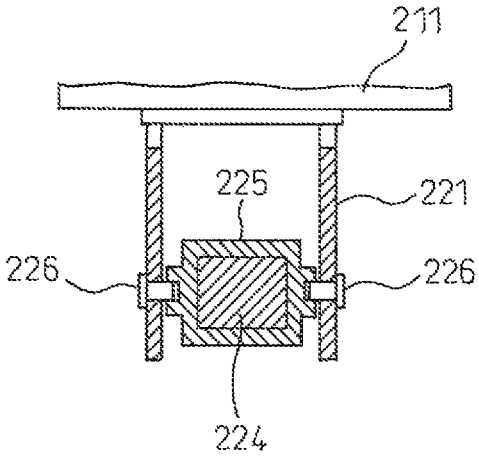
FIG. 14 is a section view when viewed from A in FIG. 13.
Figure 15:
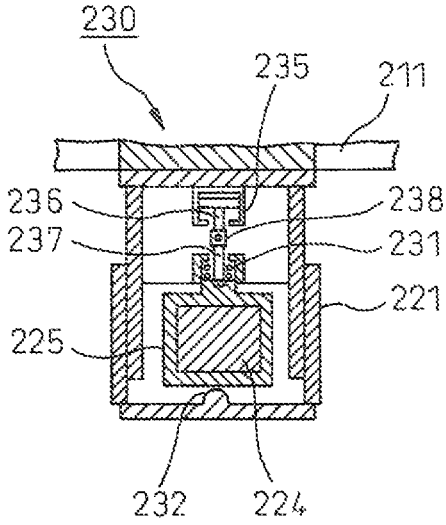
FIG. 15 is a section view when viewed from B in FIG. 13.

As shown in FIG. 14, in the center part of the fixed frame 221 under the shear cylinder 222, a shear guide 225 into which the shear slide 224 is inserted is provided so as to be supported by a spindle 226 attached to the fixed frame 221 and capable of inclining and moving. As shown in FIG. 15, the shear guide 225 is configured such that the shear guide 225 is pressed and moved in the direction toward the container 217 by an elastic body 231 of a pressing device 230 provided under the shear guide 225 and its movement is regulated by a stopper 232 having a spherical surface that comes into contact with the shear guide 225. This state determines the position of the entrance of the shear blade 229 that lowers vertically toward the die unit 212.

Further, the pressing device 230 is provided with a drive cylinder 235 and a connection shaft 237 screwed and installed to the shear guide 225 is connected to a piston rod 236 of the drive cylinder 235 via a spherical coupling 238 and the shear guide is made capable of moving in the axial direction of the extrusion press. The extrusion press is configured such that before the shear blade 229 lowers and comes into contact with the discard 241, the drive cylinder 235 is activated and the shear guide 225 and the shear slide 224 are inclined and moved, and thereby, the shear blade 229 presses the die 212 against the block 216 provided on the end platen 211.

Figure 13:
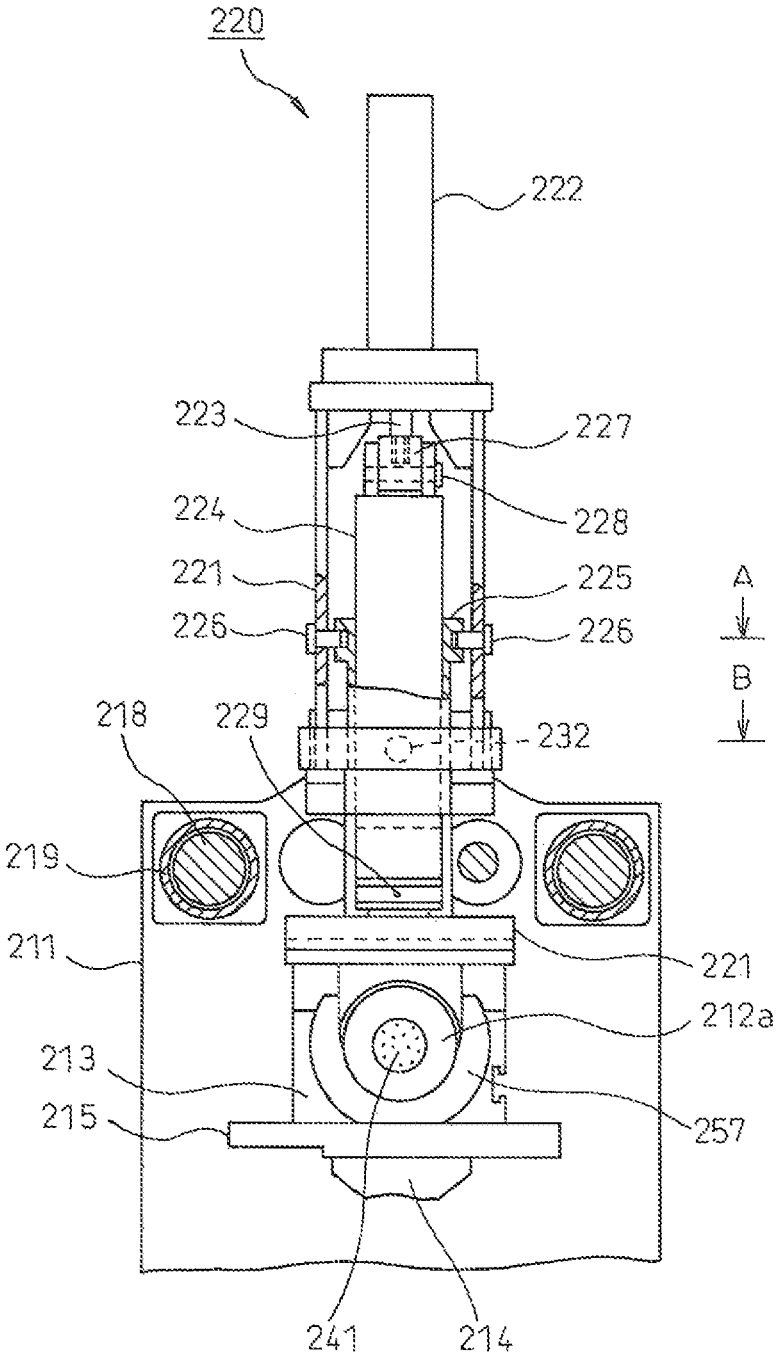
FIG. 13 is a front view of FIG. 12.

Reference symbol 218 shown in FIG. 13 denotes a tie bar that connects the main cylinder, not shown schematically, and the end platen 211, and 219 denotes a precompressed tube.

Next, the action of the discard cutting device 220 of the present invention is explained.

Figure 12:
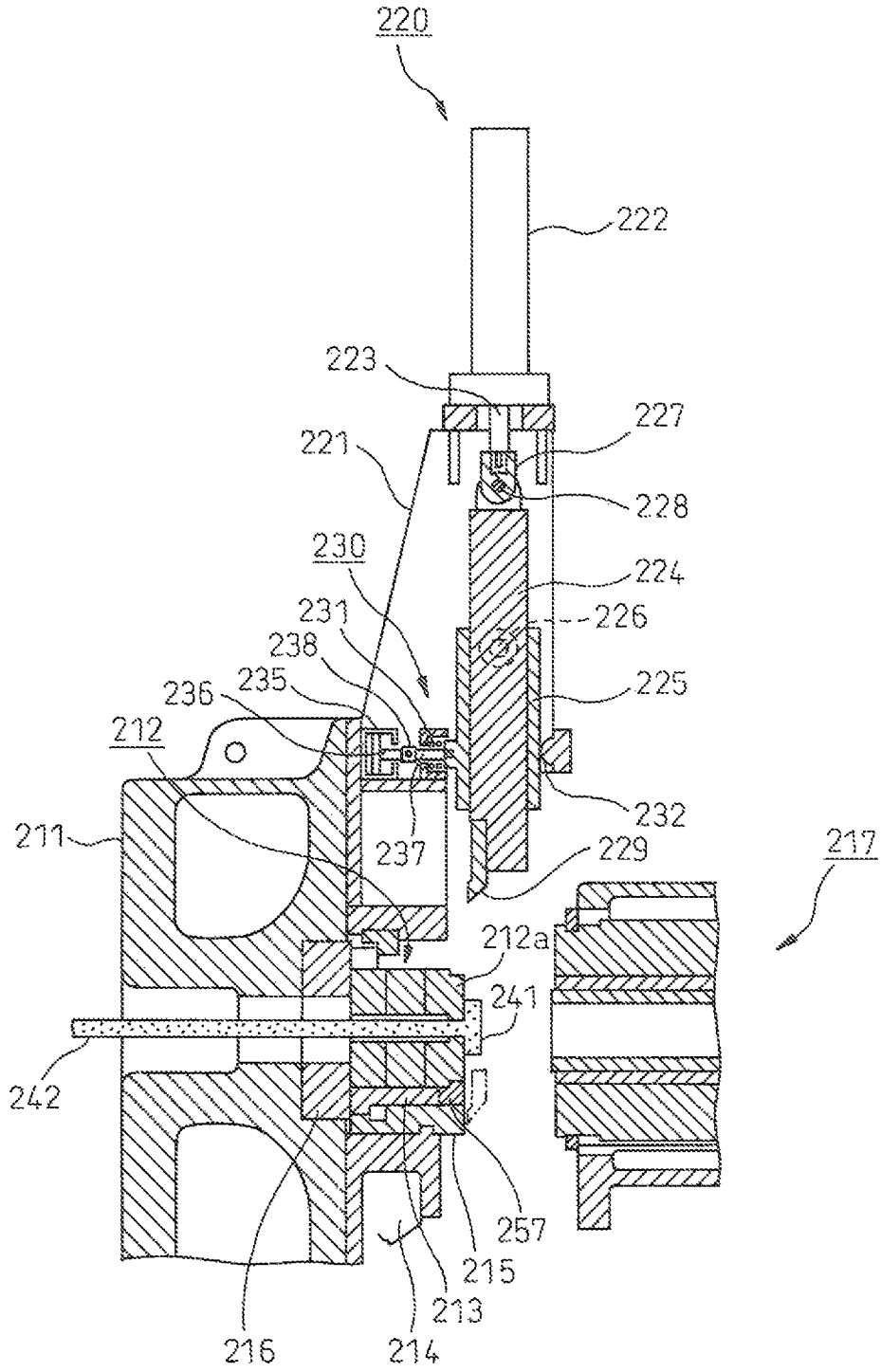
FIG. 12 is a longitudinal section view of a discard cutting device of an extrusion press for explaining an embodiment of the present invention.

First, when the extrusion of a billet is completed, the container 217 and the stem, not shown schematically, are moved back and the container 217 is separated from the die 212*a* as shown in FIG. 12. On the end surface on the side of the container 217 of the die 212*a*, the discard 241, which is the residue of billet after extrusion, is left. In this state, the shear blade 229 is at the upper limit position. Next, the shear cylinder 222 is driven and lowered to a predetermined position before the shear blade 229 hits the outer diametrical part of the discard 241. Next, the drive cylinder 235 is moved in the direction toward the die unit 212 and the shear blade 229 is pressed against the end surface of the die 212*a* and the die unit 212 is moved to the block 216 in the direction of extrusion. By this operation, it is made possible for the shear blade 229 to lower along the end surface of the die 212*a*. Subsequently, the shear blade 229 is lowered while its movement is kept so as to be along the end surface of the die 212*a* until it hits the outer diametrical part of the discard 241.

When the shear blade 229 lowers and begins to cut the discard 241, the state where the shear blade 229 is pressed against the end surface of the die 212*a* by the drive cylinder 235 is terminated. This is because, when the shear blade 229 begins to cut the discard 241, a bending moment acts on the shear slide 224 so as to press the shear blade 229 against the end surface of the die 212*a*.

From the start of the cutting to the completion of the cutting through the cutting process, the separation between the end surface of the die 212*a* and the shear blade 229 (the thickness of the discard left after the cutting) is maintained to a constant dimension, i.e., 0 to 0.2 mm, and the cut surface is in a smooth, uniform, and preferable state. As a result, it is unlikely that an irregular surface with bumps and dips is caused to occur due to the cutting out of the cut surface.

Figure 16:
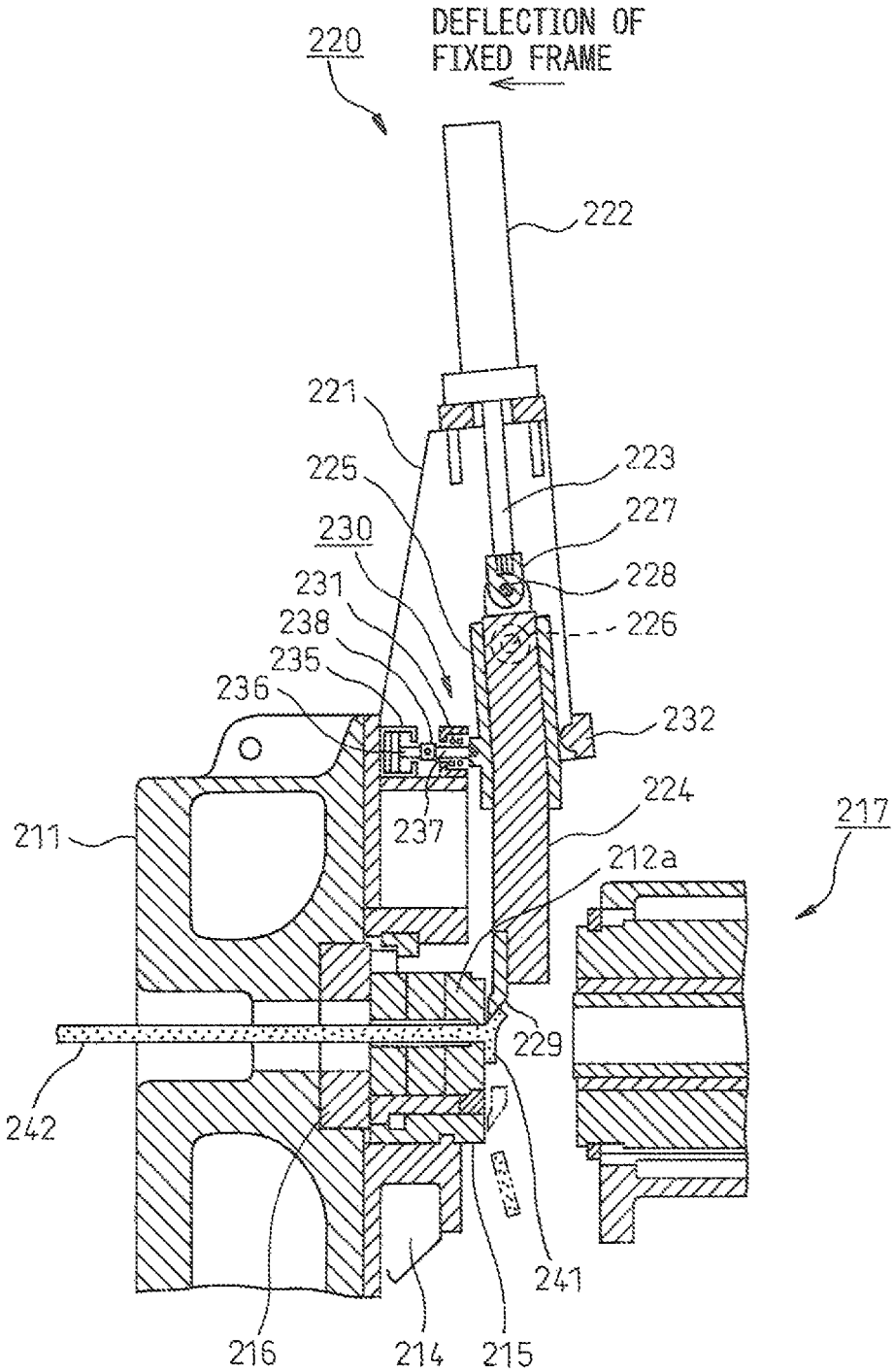
FIG. 16 is an explanatory diagram showing a state where a discard is cut by a discard cutting device of the present invention.

As shown in FIG. 16, when the dummy block 241 is cut by the shear blade 229, the shear cutting device 220 deforms and distorts in the direction toward the end platen 211. The present invention is configured such that the shear guide 225, which is a guide part of the shear slide 224 attached to the tip end of the shear blade 229, is supported pivotally by the fixed frame 221. Due to this configuration, the load that acts on the spindle 226 of the shear guide 225 is only the sliding resistance force component when the shear slide 224 operates, and therefore, it is possible to simplify the structure compared to the conventional configuration. By employing the flexible structure, it is possible to simplify the structure of the device and therefore to make an attempt to downsize the device and to reduce the cost even with the configuration in which the shear blade 229 is pressed against the end surface of the die 212*a* at the time of cutting the discard 241.

Because the present invention is configured so that the piston rod 223 and the shear slide 224 of the shear cylinder 222 are driven via the clevis 227 and the clevis pin 228, it is possible to relax the deformation of the piston rod 223 even if the fixed frame 221 and the shear slide 224 deform at the time of cutting the discard 241.

When the cutting of the discard 241 is completed and the load of the shear blade 229 on the tip end is released, the shear cutting device 220 changes from the deformed state as shown in FIG. 16 into the undeformed state shown in FIG. 12. After the cutting of the discard 241, the piston rod 223 of the shear cylinder 221 is moved in the upward direction and stopped at the upper limit position, and thus, the process of the shear cutting device is ended.

The present invention is configured so that a predetermined gap is provided between the position to which the shear blade 229 lowers (the entrance position of the blade) and the end surface of the die 212*a*. As a result, the present invention has the effect that the die unit 212 is prevented from rising when the shear blade 229 acts on the die end surface at the time of raising the shear blade 229 after the discard 241 is cut. Further, even in the state where the cut discard sticks to the tip end of the shear blade, it is unlikely that the discard sticks to the end surface of the die when the shear blade is raised.

As described above, the discard cutting device of the extrusion press of the present invention has the configuration provided with the means for pressing the shear blade against the end surface of the die without inclining or moving the entire device, and therefore, the cut surface when the discard is cut at its cutting surface is smooth and the excessive residue of the cut discard is unlikely to occur. Further, the structure is simple and simplified, and therefore, it is possible to downsize the device and reduce the cost, and it is also possible to improve safety, resulting in the contribution to the improvement of the operating rate of the extrusion press and productivity.

Further, according to the present invention, it is unlikely that the cut surface is affected even when the target is a die the section of which is large, such as a porthole die, or a product that requires shear blades with different tip end angles.

While the invention has been described by reference to specific embodiments chosen for the purposes of illustration, it should be apparent that numerous modifications could be made thereto, by those skilled in the art without departing from the basic concept and scope of the invention.

The invention claimed is:

1. An extrusion press, comprising:

a slide device of an extrusion stem; and an orthogonal billet loader that has a means for inserting a billet into a container and moves in a direction intersecting an axial direction of the extrusion press to supply a billet, wherein the billet is supplied to a space part from which the extrusion stem has slid and moved, wherein a shear cylinder and a shear guide capable of rotating in the direction toward the die and in a direction away from the die are attached facing downward to a fixed frame provided on the side of a container of an end platen that holds a die, a shear slide, the upper end part of which pivotally supports a piston rod of the shear cylinder and at the same time, to the lower end part of which a shear blade is attached, is provided to be guided within the shear guide in a sliding manner, and a discard cutting device is provided, which is configured so that the shear slide deforms at a curvature different from that of the fixed frame at the time of cutting a discard.

2. The extrusion press according to claim 1, wherein a separation between an end surface on a side of the extrusion stem of the die and an end surface on a side of the die of the container in the discard cutting process after extrusion molding is set so that there is provided a predetermined gap between an end surface on a side of a container of a shear slide, to the lowering lower end part of which a shear blade is attached, and an end surface on a side of the die of the container and at the same time, a separation between an end surface on a side of the extrusion stem of the die and a tip end surface of the extrusion stem is set so that there is provided a gap between an end surface on a side of the extrusion stem of the container and the tip end surface of the extrusion stem.

3. An extrusion press comprising a discard cutting device, wherein a container is separated from a die after extrusion molding and the discard cutting device cuts off a discard, which is the residue of a billet after extrusion, at an end surface of the die to separate the discard from an extruded product part, wherein the discard cutting device has a configuration in which:

a shear cylinder and a shear guide capable of rotating in a direction toward the die and in a direction away from the die are attached facing downward to a fixed frame provided on a side of a container of an end platen that holds a die;

a shear slide, an upper end center part of which pivotally supports a piston rod of the shear cylinder and at the same time, to a lower end part on a side of the die of which a shear blade is attached, is provided to be guided within the shear guide in a sliding manner; and sliding of the shear slide is not restricted by deformation of the fixed frame at the time of cutting a discard.

4. The extrusion press according to claim 3, wherein in the discard cutting device:

a pressing device of the shear guide capable of pressing the shear blade along an end surface of the die at the time of cutting a discard is provided on a side of the die of the fixed frame; and a stopper of the shear guide having a spherical contact surface in opposition to the pressing device capable of ensuring a gap between the shear blade and an end surface of the die when cutting of a discard is started is provided on an opposite side of the die.

5. The extrusion press according to claim 4, wherein the pressing device of the shear guide produces an output using an elastic body and a drive cylinder.

* * * * *